US006398322B1

(12) United States Patent
Chaplin

(10) Patent No.: US 6,398,322 B1
(45) Date of Patent: Jun. 4, 2002

(54) SHOWCASE

(75) Inventor: Michael Peter Brian Chaplin, Edinburgh (GB)

(73) Assignee: Netherfield Visual Limited (GB)

( * ) Notice: Subject to any disclaimer, the term of this patent is extended or adjusted under 35 U.S.C. 154(b) by 0 days.

(21) Appl. No.: 09/670,221

(22) Filed: Sep. 25, 2000

(30) Foreign Application Priority Data

Sep. 25, 1999 (GB) ..... 9922610

(51) Int. Cl.[7] ..... A47F 3/00
(52) U.S. Cl. ..... 312/140; 312/114
(58) Field of Search ..... 52/204.67, 204.62, 52/204.7, 204.597; 403/362; 312/140, 265.1, 265.2, 265.3, 265.4, 114

(56) References Cited

U.S. PATENT DOCUMENTS 633,345 A * 9/1899 Jorgeson ..... 312/140
810,857 A * 1/1906 Hallock ..... 312/140
1,264,412 A * 4/1918 Macdonald ..... 312/140
3,228,736 A * 1/1966 Beckerman ..... 312/140
4,716,693 A 1/1988 Webster ..... 52/64
4,731,973 A * 3/1988 Stenemann ..... 312/140 X
5,857,298 A * 1/1999 Fullwood ..... 52/204.597 X

FOREIGN PATENT DOCUMENTS

DE 3602539 * 7/1987 ..... 312/140

* cited by examiner

*Primary Examiner*—Janet M. Wilkens
(74) *Attorney, Agent, or Firm*—Gifford, Krass, Groh, Sprinkle, Anderson & Citkowski, P.C.

(57) ABSTRACT

A showcase comprises a base, a plurality of side walls and a roof. Elongate connecting members, for connecting the side walls to the base, each have a channel defined therein for receiving a lower edge of a respective one of the side walls. Releasable fastenings, preferably in the form of screws, are provided for fastening the connecting members to the base. Further such connecting members may also be provided for connecting the side walls to the roof. The edges of the side walls may be fixed in the respective channels of the connecting members using adhesive.

10 Claims, 3 Drawing Sheets

SHOWCASE

BACKGROUND OF THE INVENTION

Conventional glass showcases for use in museums are often of the type comprising a metal (or other material) base, four glass (or other material) side walls, and a roof, which are assembled together to form a box-shaped case in which exhibits may be displayed. The case may be fitted with internal glass shelves, or vertical planes on which paintings etc, can be hung. The showcase components are usually delivered to the museum or other location in which the showcase is to be used, and the side walls are slotted into channels provided therefor in the base and roof, and are secured in place with bonding material. Alternatively, the showcase may be delivered in assembled form, with the side walls already bonded into the channels. FIG. 1 shows a lower edge of one side wall W fixed in place in a channel C of the base B by adhesive A in the channel C. One or more small packer pads P are located in the channel C to prevent the glass wall W touching the metal base B.

The main disadvantage of this construction is that the bonded together showcase cannot thereafter be readily disassembled and reassembled. This is a particular disadvantage for temporary exhibitions, such as travelling exhibitions which must be moved from venue to venue, or within a venue where showcases are stored between exhibitions. Transportation of the assembled showcases from venue to venue, which can often mean transportation from country to country around the world, without damaging their relatively delicate structure, is difficult. Moreover, the assembled showcases are relatively bulky and heavy, requiring large transportation (or storage) volumes and special handling and packing, in turn increasing the transportation costs.

A further disadvantage of the above-described conventional showcases is that the assembly of the showcases is a relatively skilled and lengthy operation which requires fitters to be present at the first venue at which the showcases are required. The alternative is to supply the showcases already bonded together, but as above described the assembled showcases are delicate and difficult to transport given their bulky and delicate structure.

It is an object of the present invention to avoid or minimise one or more of the foregoing disadvantages.

SUMMARY OF THE INVENTION

According to the present invention there is provided a showcase comprising a base, a plurality of side walls, and a roof, wherein the showcase further includes connection means for connecting said side walls to the base, the connection means comprising a plurality of elongate connecting members, each said connecting member having a channel defined therein for receiving a lower edge of a respective one of the side walls, and releasable fastening means for fastening the connecting members to the base.

The base may be provided with complementary channels for receiving the elongate connecting members and the releasable fastening means may comprise screw means, for example grub screws, for holding (by effectively clamping) the connecting members in place. The grub screws can be released (unscrewed) to allow removal of the connecting members. Alternatively, the connecting members may be provided with flange means via which the connecting members can be screwed to the base (i.e. by screwing the flange to an adjacent surface or flange of the base). Other releasable fastening means are also possible e.g. locks, clips, catches or other suitable gripping mechanisms.

Preferably, the showcase is of box form, having four planar rectangular side walls made of glass, or another suitable transparent material, or any other rigid panel material (e.g. an opaque wall), and the base and roof are of generally rectangular end profile. In this case preferably four connecting members are provided, one for the lower edge of each side wall.

The showcase preferably also includes a further elongate connecting member for connecting each said side wall to the roof, each said further connecting member having a channel defined therein for receiving an upper edge of a respective side wall of the showcase, and further releasable fastening means for fastening these connecting members to the roof.

While the side walls are preferably of planar, rectangular form, they may alternatively take other planar geometric forms e.g. triangular, hexagonal etc. Further embodiments of the invention are also possible in which the side walls are curved, or curvilinear. In this case the elongate connecting members and the channels therein will be of complementary shape for receiving the lower or upper edges of the side walls.

The edges of the side walls are preferably fixed in place in the respective channels in which they are received in said connecting members by fixing means which may conveniently be adhesive, preferably silicon adhesive. The side walls can thus be permanently connected to the connecting members, but the connecting members are only temporarily connected to the base and/or roof, by the releasable fastening means. Thus, the assembled showcase can be easily disassembled when it needs to be transported to a new location, and then reassembled at the new location. The risk of damage to the cases also being reduced since the glass side walls can be transported more easily when packed separately, and can be stacked in parallel, this also being more economical in the transportation volume required.

Furthermore, the invention has the advantage that the need for any bonding operations to be carried out at the exhibition venue can be avoided, if desired, by simply supplying to the venue the side walls already bonded to the connecting members. It is then a relatively simple task to assemble the side walls to the base and roof and fasten them in place. Thus, the bonding operations can be carried out at the point of manufacture. This minimises assembly time and costs at the exhibition venue.

The base and/or roof may be formed as a single integral unit. Alternatively, and preferably, the base and roof each comprise a frame structure formed by a plurality of side frame members connected together in a loop, and a roof or base panel which is affixed to the frame structure so as to close the ends of the showcase. The roof or base panel can be made of glass, or another transport material, or from an opaque panel material. Where the base and/or roof is formed in this manner, the side frame members may each incorporate a channel for receiving a respective edge of the base or roof panel. The base or roof panel may be bonded into these channels or, if preferred, further connecting members of the above described type may be provided for releasably fastening the panel to the roof/base frame structure.

It will be appreciated that although bonding with adhesive is the most convenient method of fixing the side walls in place in the connecting members, other suitable fixing means, which may be permanent or temporary, could alternatively be used e.g. the connecting members could be designed to tightly grip the wall edges in the receiving channels.

BRIEF DESCRIPTION OF THE DRAWINGS

Preferred embodiments of the invention will now be described by way of example only and with reference to the accompanying drawings in which.

DETAILED DESCRIPTION OF CERTAIN EMBODIMENTS

Figure 2:
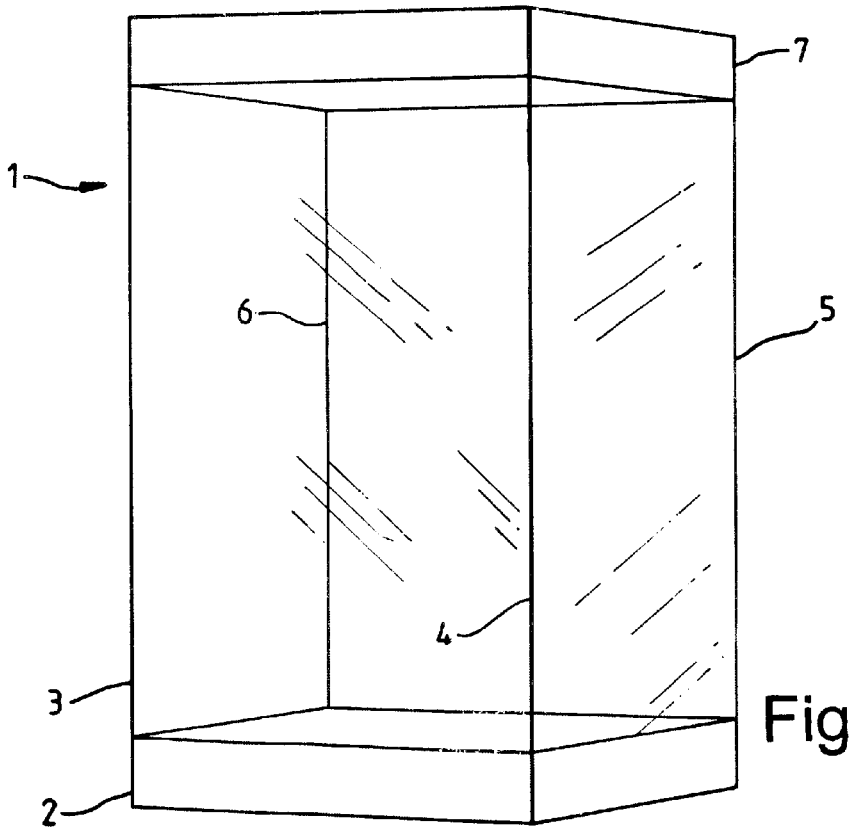
FIG. 2 is a perspective view of a showcase.

FIG. 2 shows a showcase for housing exhibits. The showcase 1 is of box shape, comprising a base 2, four rectangular glass side walls 3,4,5,6, and a roof 7. The base rests on the floor or other supporting surface at the exhibition venue. The base 2 and roof 7 are aluminium extrusions and are of similar configuration (although in other possible embodiments—see FIG. 6—the structure of the base and roof may be different). Each comprises a frame formed by four elongate hollow side members connected at right angles so as to form a rectangular structure. A roof panel (not shown) rests on, or is affixed to, the frame structure formed by the four elongate side members so as to close the upper end of the showcase. A similar base panel (not shown) may optionally be provided to close the lower end of the showcase.

Figure 1:
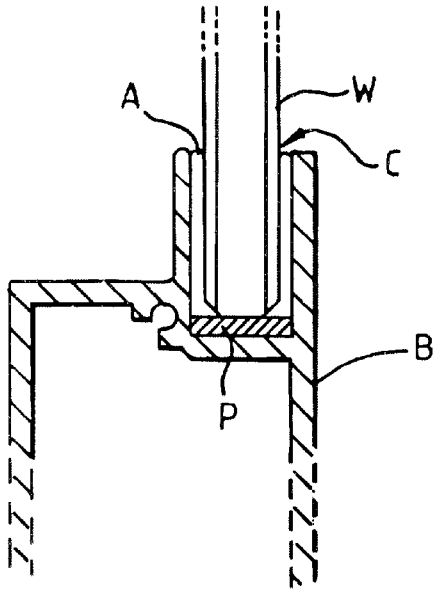
Fig. 1 PRIOR ART
FIG. 1 illustrates a prior art mounting arrangement for mounting a glass (or other material) wall to a metal base or roof of a showcase.
Figure 3:
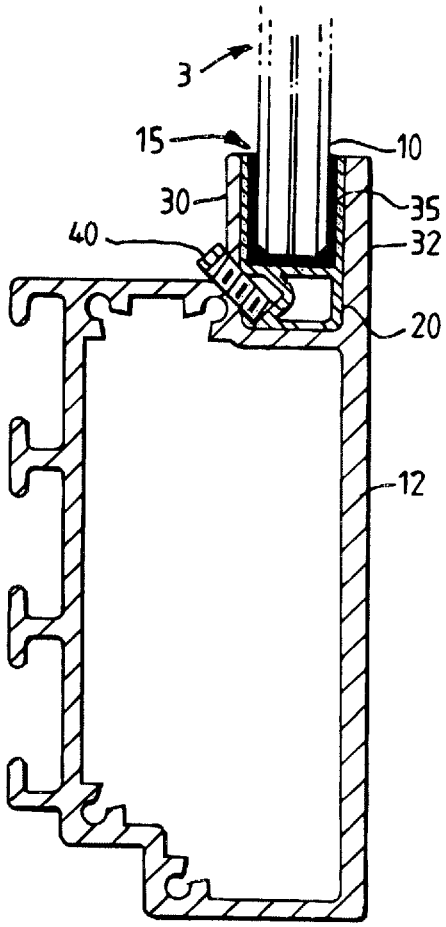
FIG. 3 is a cross-sectional end view of one side member of the base of the showcase of FIG. 2, in which a glass side wall is mounted in a novel manner.
Figure 4:
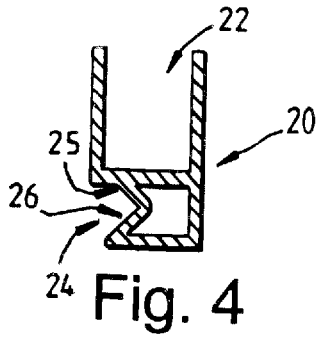
FIG. 4 is a cross-sectional end view of a connecting member used in the embodiment of FIG. 3.

FIG. 3 shows a mounting arrangement for mounting a lower edge of one of the glass wall panels 3 to a respective elongate side member 12 of the base 2. A similar mounting arrangement is provided at the lower edge of each of the glass side walls 3,4,5,6 of the showcase 1. The hollow elongate side member 12 (shown in cross-section) of the base incorporates a channel 15 receiving a separate elongate connecting member 20 therein. Both the channel 15 and the connecting member 20 extend along the full width of the showcase. The separate connecting member is shown on its own in FIG. 4. It can be seen from FIGS. 3 and 4 that the connecting member 20 itself incorporates a channel 22 (of generally U-shaped cross-section) for receiving the lower edge 10 of the glass side wall 3. The connecting member further incorporates, below the channel 22 defined therein, an elongate groove 24, extending along the length of the connecting member 20. The groove is generally V-shaped, being formed by two sloped surfaces 25, 26. The channel 15 in the elongate side member 12 of the base is of generally U-shaped cross-section formed by two protruding edge portions 30, 32 of the elongate base member 12. The connecting member is configured so as to fit relatively snugly in the channel 15. Silicon or other adhesive 35 (shown blocked in in black, in FIG. 3) is introduced into the channel 22 of the connecting member 20 via which adhesive the glass side wall 3 is bonded in place in the connecting member 20. As in the FIG. 1 prior art arrangement one or more small packer pads P (not shown) may be used to prevent the glass wall 3 from touching the base surface of the connecting member in the channel 22 therein.

The lower sloped surface 26 of the groove 24 in the connecting member 20 is angled such that a plurality of grub screws 40 (or other releasable fasteners) provided with the base 2, and extending through the innermost protruding edge portion 30 of the base into the channel 15 (at spaced intervals along the length of the connecting member 20) formed therein, can be tightened so as to grip the lower sloped surface 26 of the groove 24, so as to fasten the connecting member 20 firmly in place in the channel 15 of the base side member 12.

A connecting arrangement like that shown in FIG. 3 is provided for the lower edge of each of the four side walls 3,4,5,6 of the showcase, for releasably fastening each side wall to a respective elongate side member 12 of the base 2. Additionally, a similar arrangement is provided for each side wall, at the upper edge of each side wall, for fastening the upper edge to the roof 7. The roof 7 is similarly provided with a respective channel 15 along each side, for receiving the respective connecting member 20. When the showcase is to be dismantled, the grub screws are simply released to allow all the connecting members 20 to be removed from their respective channels 15 in the base 2 and roof 7, so that the glass side walls can be stacked for storage, or packed individually for transportation.

Figure 5:
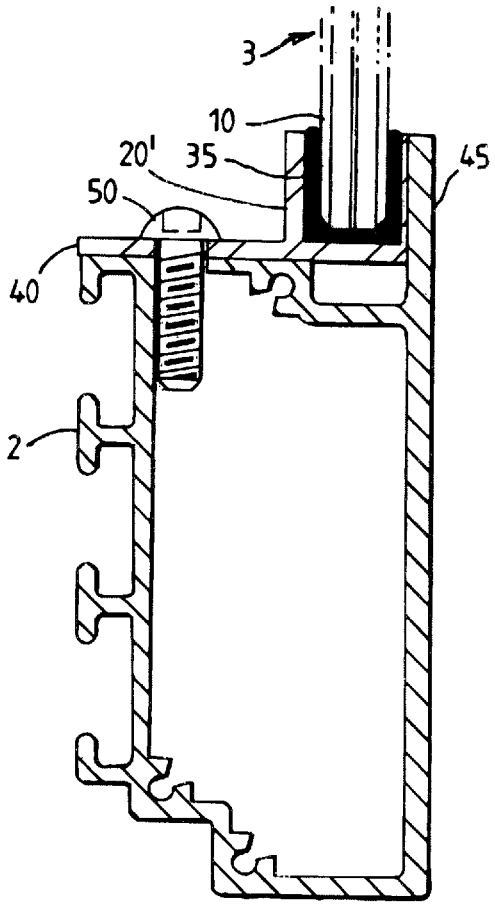
FIG. 5 is a cross-sectional end view of one side member of the base of the showcase of FIG. 2, in which a glass side wall is mounted in an alternative novel manner.

FIG. 5 shows an alternative arrangement for connecting the lower and upper edges of the walls to the base 2 and roof 7 respectively. In this arrangement, the connecting member 20, is simply a generally U-shaped extrusion with a projecting side flange 40 extending along the length of the connecting member. Screws 50 (or other releasable fastenings) are provided for fastening the connecting members to the base 2, through the side flanges 40. Each outer side of the base 2 is provided with a projecting edge portion 45 for supporting the respective connecting member 20'.

Figure 6:
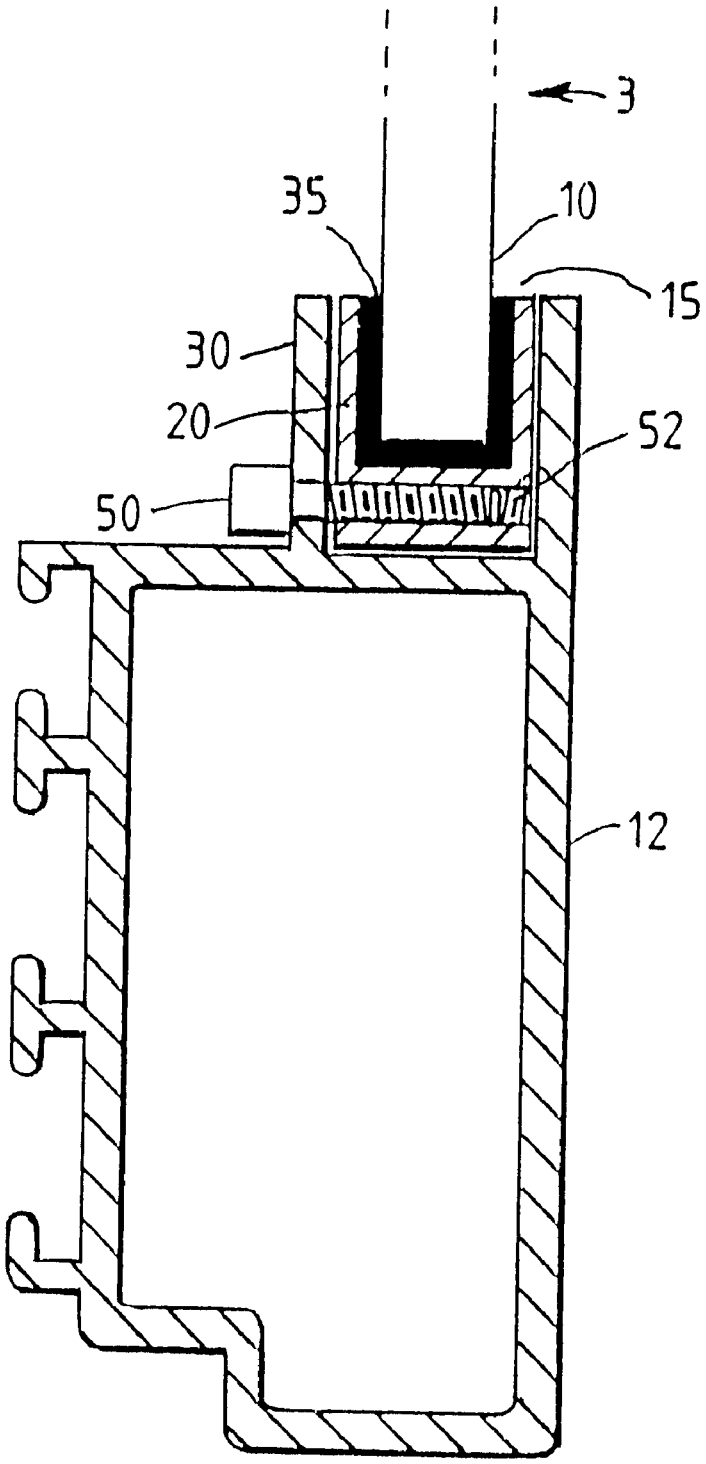
FIG. 6 is a cross-sectional end view of one side member of the base of the showcase of FIG. 2, in which a glass side wall is mounted in a further alternative novel manner.

FIG. 6 shows another possible arrangement for connecting the lower and upper edges of the walls to the base 2 and roof 7 respectively. In this arrangement, the base 2 again incorporates a channel 15 for receiving a separate connecting member 20, as in the FIG. 3 embodiment. Instead of grub screws as used in the FIG. 3 embodiment, in the FIG. 6 embodiment screws 50 are screwed through the innermost protruding edge portion 30 of the base, into a screw threaded bore 52 provided therefor in a lower portion of the connecting member 20, so as to fasten the connecting member firmly to the base 2.

Figure 7:
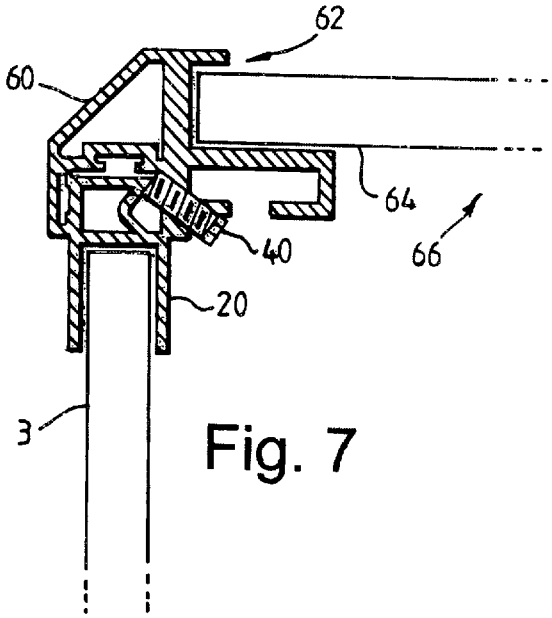
FIG. 7 is a cross-sectional end view of one side member of a roof of a showcase according to another embodiment of the invention.

FIG. 7 illustrates a convenient arrangement for mounting a glass lid (or panel of any other transparent or opaque material) to the roof frame 7. FIG. 7 shows one side wall 3 and the connecting member 20 connecting the side wall 3 to a side frame member 60 of the roof frame 7. The side frame member 60 incorporates a channel 62 therein for receiving a respective edge 64 of the glass lid 66. The lid edges are preferably bonded in the channels 62 by adhesive. Alternatively, further connecting members 20 may be provided for connecting the glass lid to the roof frame members 60.

Although the above-described embodiments refer to the base and roof being formed of metal extrusions, it will be appreciated that they could in fact be formed from any suitable natural, synthetic or composite materials, or combinations of these could be used. Similarly, although the above-described embodiments describe all the side walls 3, 4, 5, 6 being made of glass, one or more of the side walls could be made of any other solid panel material, which could be opaque or transparent (e.g. one side wall may be an opaque backing panel against which objects will be displayed).

I claim:

1. A showcase comprising a base, a plurality of side walls and a roof, wherein the showcase further includes connection means for connecting said side walls to the base, the connection means comprising a plurality of elongate connecting members, each said connecting member having a channel defined therein for receiving a lower edge of a respective one of the side walls, and releasable fastening means for fastening the connecting members to the base, the base being provided with complementary channels for receiving the elongate connecting members, the releasable fastening means further comprising screw means for holding the connecting members in place, the screw means comprising a plurality of grub screws for clamping the connecting members in place.

2. A showcase according to claim 1, wherein the lower edges of the side walls are fixed in place in the respective channels in which they are received in said connecting members by fixing means.

3. A showcase according to claim 2, wherein the fixing means comprises adhesive.

4. A showcase comprising a base, a plurality of side walls and a roof, wherein the showcase further includes connection means for connecting said side walls to the base, the connection means comprising a plurality of elongate connecting members, each said connecting member having a channel defined therein for receiving a lower edge of a respective one of the side walls, and releasable fastening means for fastening the connection members to the base, wherein the connecting members are provided with flange means via which the connecting members are fastened to the base using screw means.

5. A showcase according to claim 4, wherein the lower edges of the side walls are fixed in place in the respective channels in which they are received in said connecting members by fixing means.

6. A showcase according to claim 5, wherein the fixing means comprises adhesive.

7. A showcase comprising a base, a plurality of side walls, and a roof, wherein the showcase further includes base connection means for connecting said side walls to the base, the base connection means comprising a plurality of elongate base connecting members, each said base connecting member having a channel defined therein for receiving a lower edge of a respective one of the side walls, and releasable fastening means for fastening the base connecting members to the base, roof connection means comprising a plurality of elongate roof connecting members for connecting each said side wall to the roof, each said roof connecting member having a channel defined therein for receiving an upper edge of a respective said side wall of the showcase, and further releasable fastening means for fastening said roof connecting members to the roof, the base and roof each comprising a frame structure formed by a plurality of side frame members connected together in a loop, and a roof/base panel which is affixed to the frame structure so as to close an end of the showcase and wherein the side frame members each incorporate a channel for receiving a respective edge of the base or roof panel.

8. A showcase according to claim 7, wherein further elongate connecting members are provided via which the base and roof panels are releasably fastened to one of the respective roof and base frame structure using releasable fastening means.

9. A showcase according to claim 7, wherein the lower edges of the side walls are fixed in place in the respective channels in which they are received in said base connecting members by fixing means.

10. A showcase according to claim 9, wherein the fixing means comprises adhesive.

* * * * *